US007581272B2

(12) United States Patent
Xie et al.

(10) Patent No.: US 7,581,272 B2
(45) Date of Patent: Sep. 1, 2009

(54) DYNAMIC LOAD DETECTION FOR A CLOTHES WASHER

(75) Inventors: Mark Mingjun Xie, St. Joseph, MI (US); Scott D. Slabbekoorn, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 530 days.

(21) Appl. No.: 11/438,001

(22) Filed: May 19, 2006

(65) Prior Publication Data

US 2007/0266504 A1 Nov. 22, 2007

(51) Int. Cl.
*D06F 33/00* (2006.01)
*D06F 35/00* (2006.01)

(52) U.S. Cl. ..... 8/159

(58) Field of Classification Search ..... 8/158–159; 68/12.06, 12.12, 12.23, 12.27, 23.1
See application file for complete search history.

(56) References Cited

U.S. PATENT DOCUMENTS

| | | | | |
|---|---|---|---|---|
| 5,280,660 | A | 1/1994 | Pellerin et al. | 8/158 |
| 5,930,855 | A | 8/1999 | Vande Haar et al. | 8/159 |
| 6,129,768 | A | 10/2000 | Johnson et al. | 8/159 |
| 6,134,926 | A | 10/2000 | Vande Haar et al. | 68/12.06 |
| 6,151,930 | A | 11/2000 | Carlson | 68/12.06 |
| 6,477,867 | B1 | 11/2002 | Collecutt et al. | 68/12.06 |
| 6,507,799 | B2 | 1/2003 | Steffen | 702/96 |
| 6,510,715 | B1 | 1/2003 | Simsek | 68/12.06 |
| 6,530,100 | B2 | 3/2003 | Conrath | 8/159 |
| 6,546,354 | B1 | 4/2003 | Gayme | 702/147 |
| 6,640,372 | B2 | 11/2003 | Ciancimino et al. | |
| 6,654,975 | B2 | 12/2003 | Broker | 8/159 |
| 6,687,572 | B2 | 2/2004 | Stalsberg et al. | 700/279 |
| 2005/0066450 | A1 * | 3/2005 | Weinmann | 8/159 |

FOREIGN PATENT DOCUMENTS

| | | | |
|---|---|---|---|
| DE | 3117106 | A1 | 11/1982 |
| DE | 19616985 | A1 | 10/1997 |
| EP | 1167609 | | 2/2002 |
| EP | 1342826 | A1 | 9/2003 |
| EP | 1519178 | A1 | 3/2005 |
| EP | 1607729 | A1 | 12/2005 |
| GB | 2073257 | | 10/1981 |
| WO | 2006/026949 | A1 | 3/2006 |

OTHER PUBLICATIONS

Electronic English translation of DE 19616985 (cited by Applicant).*

* cited by examiner

*Primary Examiner*—Joseph L Perrin
(74) *Attorney, Agent, or Firm*—Clifton G. Green; McGarry Bair P.C.

(57) ABSTRACT

A method for controlling the spin cycle in an automatic clothes washer. The clothes washer comprises an imperforate tub, a perforate basket located within the tub, a bearing assembly carried by the tub, a drive shaft rotationally supported in the bearing assembly and coupled to the basket to define a rotational axis of the basket, a drive assembly rotating the drive shaft, and a controller operably to the drive assembly, with the controller controlling the drive mechanism to control the spin rate of the basket according to a spin cycle. The method comprises sensing a moment acting on the bearing, and controlling the spin rate of the basket in response to the sensed moment.

16 Claims, 15 Drawing Sheets

Preliminary Limit Setting and Spin Time Setting

| RPM | 40 | 70 | 140 | 400 | 600 | 800 | 1000 | 1200 |
|---|---|---|---|---|---|---|---|---|
| Limit setting, XY | | L70 | L140 | L400 | L600 | L800 | L1000 | L1200 |
| Volt | | 0.05 | 0.0625 | 0.484 | 0.750 | 0.938 | 1.188 | 1.406 |
| Time setting | T40 | T70 | T140 | T400 | T600 | T800 | T1000 | T1200 |
| Spinning/ramp-up time, sec | 30 | 120 | 10 | 90 | 30 | 30 | 60 | 180 |

| | | |
|---|---|---|
| Lsb1 | Lsb2 | |
| 20 | 22 | |
| Tpause | Tstop | Tt |
| 5 | 180 | 45 |

Fig. 9A

2g Accelerometer Specification

| Parameter | Spec |
|---|---|
| Range | ± 5g |
| Sensitivity | 8% Duty/g |
| Operating Temp | 10~40 deg C |
| Freq out | 400 Hz |
| Output Volt | 0.312 v/g |
| Noise density RMS | 0.8 mg/sqr Hz |

Fig. 9B

DYNAMIC LOAD DETECTION FOR A CLOTHES WASHER

BACKGROUND OF THE INVENTION

1. Field of the Invention

The invention relates generally to automatic clothes washers, and, more specifically relates to an automatic clothes washer and method for determining an unbalanced condition, especially a dynamic unbalanced condition.

2. Description of the Related Art

Washing machines utilize a generally cylindrical perforated basket for holding clothing and other articles to be washed that is rotatably mounted within an imperforate tub mounted for containing the wash liquid, which generally comprises water, detergent or soap, and perhaps other constituents. In some machines the basket rotates independently of the tub and in other machines the basket and tub both rotate. Typically, an electric motor drives the basket. Various wash cycles introduce into the clothing and extract from the clothing the wash liquid, usually ending with one or more spin cycles where final rinse water is extracted from the clothes by spinning the basket.

It is common to categorize washing machines by the orientation of the basket. Vertical-axis washing machines have the basket situated to spin about a vertical axis relative to gravity. Horizontal-axis washing machines have the basket oriented to spin about an essentially horizontal axis relative to gravity.

Both vertical and horizontal-axis washing machines extract water from clothes by spinning the basket about their respective axes, such that centrifugal force extracts water from the clothes. Spin speeds are typically high in order to extract the maximum amount of water from the clothes in the shortest possible time, thus saving time and energy. But when clothing and water are not evenly distributed about the axis of the basket, an imbalance condition occurs. Typical spin speeds in a vertical axis washer are 700-800 RPM, and in a horizontal axis washer at 1000-1200 RPM. At such high speeds, an imbalance can result in unacceptable vibratory movement of the basket and the entire washing machine. The washing machine can be affected severely enough that it will "walk" across the floor and cause floor vibration. The tub and basket can move enough such that the tub reaches the limit of its suspension and/or contacts the surrounding cabinet structure, referred to as "cabinet hits," with consequent noise and possible damage.

Moreover, demand for greater load capacity fuels a demand for larger baskets. Higher spin speeds coupled with larger capacity baskets aggravates imbalance problems in washing machines, especially in horizontal axis washers. Imbalance conditions become harder to accurately detect and correct.

As the washing machine basket spins about its axis, there are generally two types of imbalances that it may exhibit: static (single) imbalance and dynamic (coupled) imbalance. FIGS. 1-4 illustrate schematically different configurations of imbalance in a horizontal axis washer 10 having a perforate basket 18 having a horizontal geometric axis 21, and coaxially enclosed within an imperforate, stationary tub 20 having a front 15 with an opening 30 (through which access to the interior of the basket 18 is normally provided) and a back 17. The tub 20 is suspended by one or more springs 32 within a cabinet 12. A drive point 19 (usually a motor shaft) is typically located at the back 17. One or more dampers or shock absorbers 34 are attached to the tub 20, generally diametrically opposite the springs 32.

FIGS. 1A and B show a single or static imbalance condition generated by a single off-balance load 80. Imagine a load 80 on one side of the basket 18, but centered between the front 15 and the back 17. A torque t caused by the magnitude of the imbalance is equal to $$t=mgR$$

Where m=mass of the imbalance;

g=gravitational acceleration;

R=radial location of the imbalance.

The suspension system having the springs 32 and the dampers 34 is designed to handle such vibration under normal conditions. During rotation the motor will consume energy to lift the imbalance weight, or overcome the torque t. Therefore static imbalances are detectable at relatively slow speeds such as 85 or 100 RPM by measuring the fluctuation of speed, current, or watts of the driving motor.

Coupled or dynamic imbalance is shown in FIG. 2. Imagine a dynamic off balance load of two identical masses 82, one on one side of the basket 18 near the front 15 and the other near the back 17. In other words, the masses 82 are on a line 84 skewed relative to the geometric axis 21. The torque t due to imbalance gravity about the geometric axis 21 is zero, so there is no fluctuation of speed, current or watts and the motor cannot detect current the imbalance. However, there is a net moment torque M, so that the basket 18 will tend to wobble about an axis perpendicular to the plane of FIG. 2B. If the moment is high enough, the wobble can be unacceptable.

FIGS. 3A and B illustrate a single imbalance caused by a front off-balance load. Imagine a single load 86 in the basket 18 toward the front 15. There is a torque t due to imbalance gravity about the geometric axis 21. There is also a moment M, about an axis perpendicular to the plane of FIG. 3B.

FIGS. 4A and B illustrate a single imbalance caused by a rear off-balance load. Imagine a single load 88 in the basket 18 toward the back 17. There is a torque t due to imbalance gravity about the geometric axis 21. There is also a moment M, about an axis perpendicular to the plane of FIG. 4B.

A single imbalance load is detectable above a certain speed at which the clothes load settles inside the basket. At the static imbalance detection speed (about 85-100 RPM for a horizontal axis washer), the torque t is transferred to the motor shaft, causing speed or power fluctuation in the motor. But the estimated value is related only to the effect of the static imbalance. For instance, in FIGS. 1, 3 and 4, the three single imbalance loads yield an identical value regardless of whether the load is located at the front as in FIG. 3 or the back as in FIG. 4. This single static imbalance is correlated to the magnitude of the imbalance. However, dynamically, there is a significant difference when an imbalance load is in the front or at the back. The front imbalance load in FIG. 3 has a much larger moment M compared with that of the back imbalance load in FIG. 4, because the instant pivot point is at the rear bearings support area. For simplicity, we will assume pivot point is at the front bearing for later discussion.

The coupled dynamic imbalance effect in a horizontal axis washing machine can be seen in FIG. 5, where the magnitude of the imbalance load, in kilograms, and the dynamic moment (or location of the imbalance back to front) are defined as two axes in a Cartesian coordinate plane. In this plane, the whole area is separated into two parts by a dynamic moment limit curve BE defined by the tolerances of the particular washing machine. BE represents the acceptable moment with respected to vibration level that is related to the effects of dynamic imbalance load at a given RPM. There are a set of such curves corresponding to different high spinning speeds.

The area above this limit curve is the unacceptable imbalance area at a given spinning speed. The area below the limit curve is the accepted operating region. Note, as explained above, that there is a significant difference in the effect of the moment on the curve BE between the front and the back. The imbalance at the front has larger dynamic effects that result in larger vibration.

Imagine detecting only a single static imbalance using current motor speed, current, or watts technology. To avoid severe vibration at the front, a low limit setting (at line AB) must be established in the washing machine by assuming a worst case. Consequently, all area between the curve BE and above the line AB represents an overestimated difference between the actual speed permitted by the motor controller (limited by line AB) and the maximum speed at which the machine could operate (limited by the curve BE. If the limit setting is established higher, as at the line CD, the area between the curve BE and below the line CD represents an underestimate for a front imbalance, and the area between the curve BE and above the line CD represents an overestimate for a rear imbalance. A consequent result is unacceptable vibration and noise at high speed due to the underestimate. Thus, there is an additional need to detect the location of an imbalance load in a horizontal axis washing machine, as well as the existence of any coupled dynamic imbalance.

Many efforts have been put for detecting location of single static imbalance, as well as coupled dynamic imbalance but not successful. Many solutions have been advanced for detecting and correcting single static imbalance but correction is generally limited to aborting the spin, reducing the spin speed, or changing the loads in or on the basket. Detection presents the more difficult problem. It is known to detect vibration directly by employing switches, such as mercury or micro-switches, which are engaged when excessive vibrations are encountered. Activation of these switches is relayed to a controller for altering the operational state of the machine. It is also known to use electrical signals from load cells on the bearing mounts of the basket, which are sent to the controller. Other known methods sample speed variations during the spin cycle and relate it to power consumption. For example, it is known to have a controller send a PWM (Pulse Width Modulated) signal to the motor controller for the basket, and measure a feedback signal for RPM (Rotations Per Minute) achieved at each revolution of the basket. Fluctuations in the PWM signal correspond to basket imbalance, at any given RPM. Yet other methods measure power or torque fluctuations by sensing current changes in the drive motor. Solutions for detecting static imbalances by measuring torque fluctuations in the motor abound. But there is no correlation between static imbalance conditions and dynamic imbalance conditions; applying a static imbalance algorithm to torque fluctuations will not accurately detect a dynamic imbalance.

For example, an imbalance condition caused by a front off balance load (see FIG. 3) will be underestimated by existing systems for measuring static imbalances. Conversely, an imbalance condition caused by a rear off balance load (see FIG. 4) will be overestimated by existing systems for measuring static imbalances.

Moreover, speed, torque, current, watts in the motor can all fluctuate for reasons unrelated to basket imbalance. For example, friction conditions can change over time and from system to system. Friction in a washing machine has two sources. One may be called "system friction." Because of differences in the bearings, suspension stiffness, machine age, normal wear, motor temperature, belt tension, and the like, the variation of system friction can be significantly large between one washing machine and another. A second source of friction in a given washing machine is related to load size and any imbalance condition. Commonly owned U.S. Pat. No. 6,640,372 presents a solution to factoring out conditions unrelated to basket imbalance by establishing a stepped speed profile in which average motor current is measured at each step and an algorithm is applied to predetermined thresholds for ascertaining an unbalanced state of the basket. Corrective action by the controller will reduce spin speed to minimize vibration. The particular algorithm in the '372 patent may be accurate for ascertaining static imbalances. However, it is not entirely accurate for horizontal axis washing machines because it does not accurately ascertain the various dynamic imbalance conditions and does not ascertain information related to load size.

Another problem in reliably detecting imbalances in production washers regardless of axis is presented by the fact that motors, controllers, and signal noise vary considerably from unit to unit. Thus, for example, a change in motor torque in one unit may be an accurate correlation to a given imbalance condition in that unit, but the same change in torque in another unit may not be an accurate correlation for the same imbalance condition. In fact, the problems of variance among units and signal noise are common to any appliance where power measurements are based on signals that are taken from electronic components and processed for further use.

Prior art horizontal axis washing machines utilize motor torque, or current, motor speed, and motor watts, to detect a load imbalance. However such technologies cannot detect coupled dynamic loads, are unable to base corrective action on the location of the imbalance, overcompensate for load imbalances at the rear of the basket and under compensate for load imbalances at the front of the basket. Accelerometers are utilized to monitor vibration and enable preventative measures to be taken to avoid catastrophic vibration at high speeds, i.e. 400 RPM and above. However the critical speed for vibration-caused cabinet hits is typically between 160 and 200 RPM, well before the 400 RPM speed is reached. Furthermore, the use of accelerometers typically does not enable the determination of the imbalance location, or the severity of vibration at higher speeds. However, accelerometers have the advantage of low cost, a well-understood operational theory, and performance unaffected by system friction, or variation in motors, controllers, and signal noise.

There exists a need in the art for an accelerometer-based imbalance detection system for a washing machine, particularly horizontal axis washing machines, which can effectively, efficiently, reliably and accurately sense load size, the existence and magnitude of any imbalance condition, and sense other obstructions that may adversely affect performance. Further, there is a need for accurately determining stable and robust power information that can accommodate variations in motors, controllers, system friction, and signal noise from unit to unit.

SUMMARY OF THE INVENTION

A method for controlling the spin cycle in an automatic clothes washer. The clothes washer comprises an imperforate tub, a perforate basket located within the tub, a bearing assembly carried by the tub, a drive shaft rotationally supported in the bearing assembly and coupled to the basket to define a rotational axis of the basket, a drive assembly rotating the drive shaft, and a controller operably to the drive assembly, with the controller controlling the drive mechanism to control the spin rate of the basket according to a spin cycle. The method comprises sensing a moment acting on the bearing, and controlling the spin rate of the basket in response to the sensed moment. The objective for this invention is to reduce vibration, save time and energy, and bring more loads up to highest speeds.

BRIEF DESCRIPTION OF THE DRAWINGS

In the drawings:

FIG. 9A is a tabulation of preliminary limit settings for selected rotational velocities of the basket illustrated in FIG. 7.

FIG. 9B is a tabulation of specifications for an accelerometer corresponding to the preliminary limit settings illustrated in FIG. 9A.

DESCRIPTION OF AN EMBODIMENT OF THE INVENTION

Figure 1A:
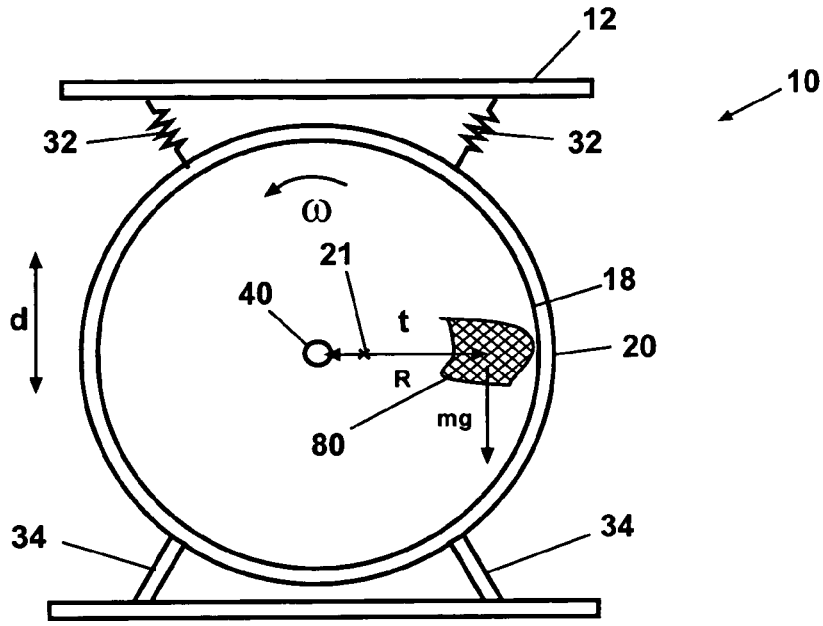
Fig. 1A (PRIOR ART)
FIGS. 1A and B are front and side elevational schematic representations of a horizontal axis washing machine subject to a single static imbalance loading condition. The imbalance is located in the middle of the drum.
Figure 1B:
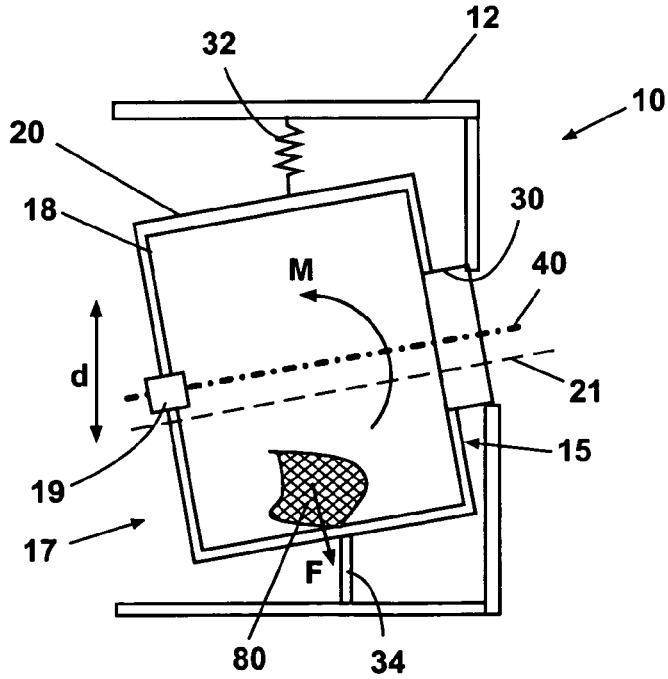
Fig. 1B (PRIOR ART)
Figure 2A:
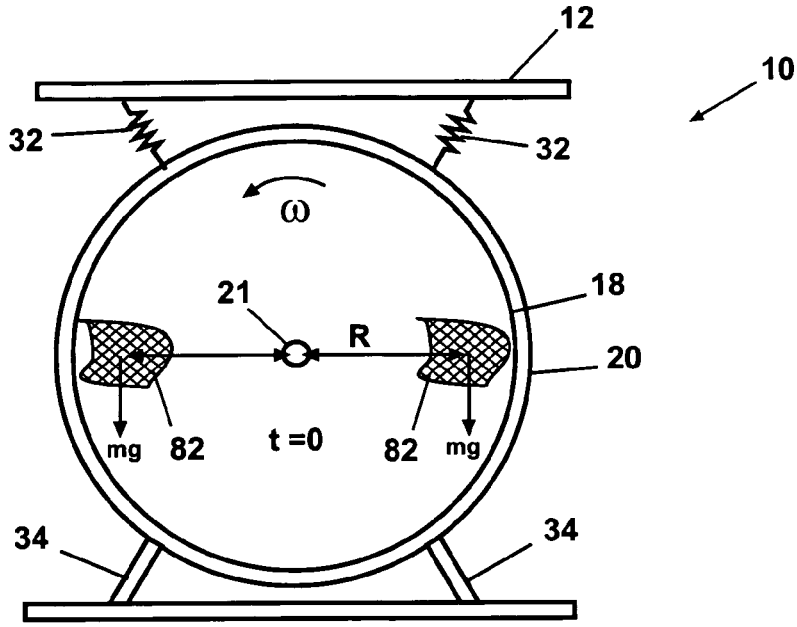
Fig. 2A (PRIOR ART)
FIGS. 2A and B are front and side elevational schematic representations of a horizontal axis washing machine subject to a coupled dynamic imbalance loading condition.
Figure 2B:
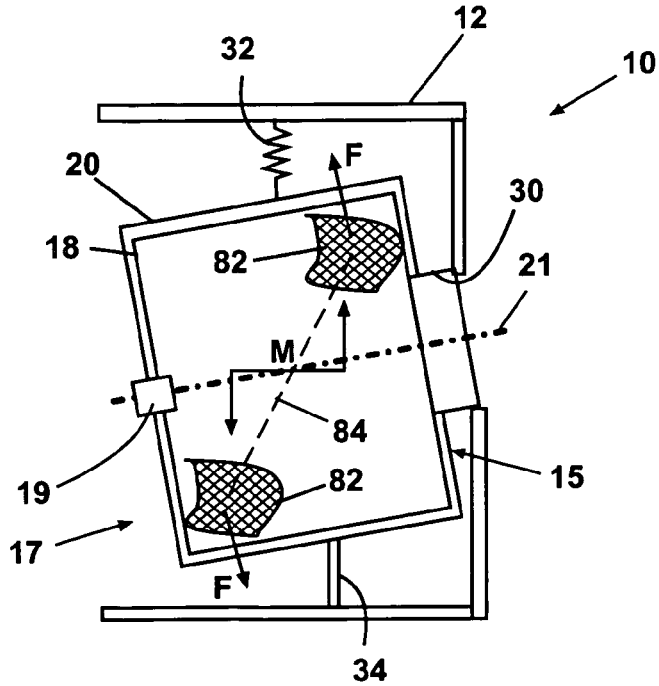
Fig. 2B (PRIOR ART)
Figure 3A:
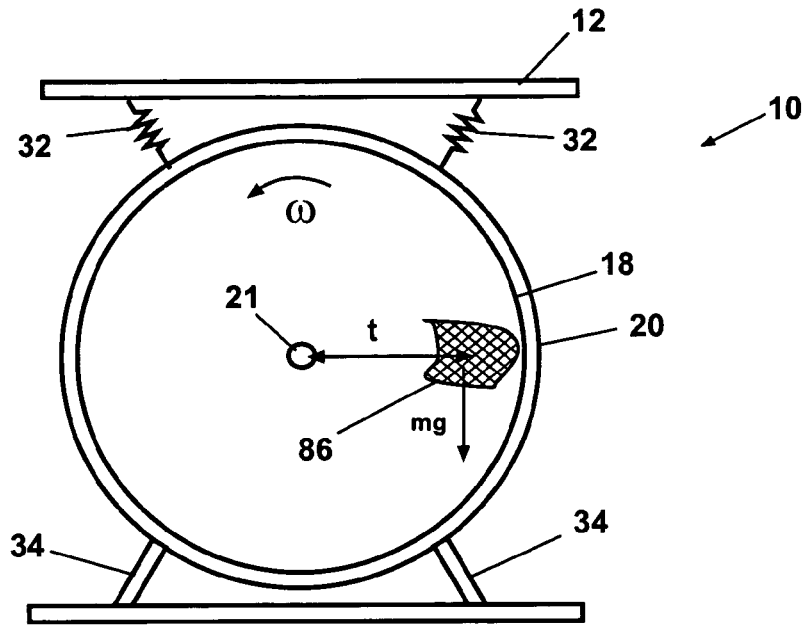
Fig. 3A (PRIOR ART)
FIGS. 3A and B are front and side elevational schematic representations of a horizontal axis washing machine subject to a front single imbalance loading condition.
Figure 3B:
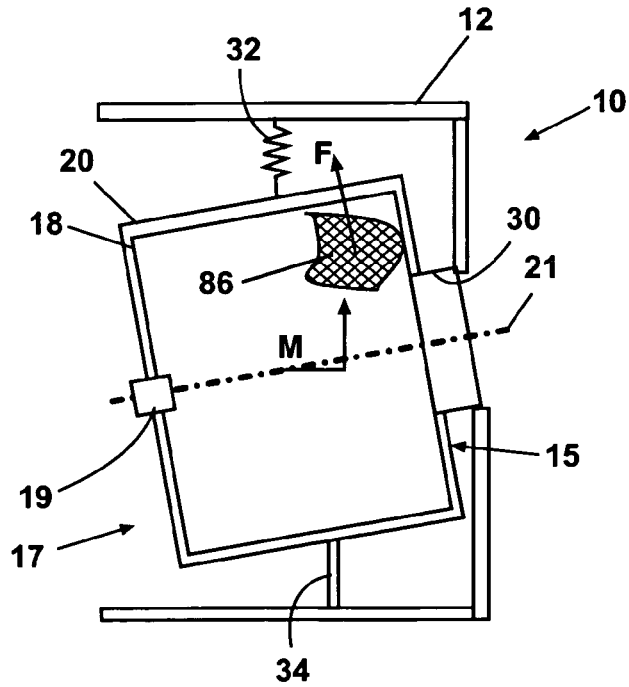
Fig. 3B (PRIOR ART)
Figure 4A:
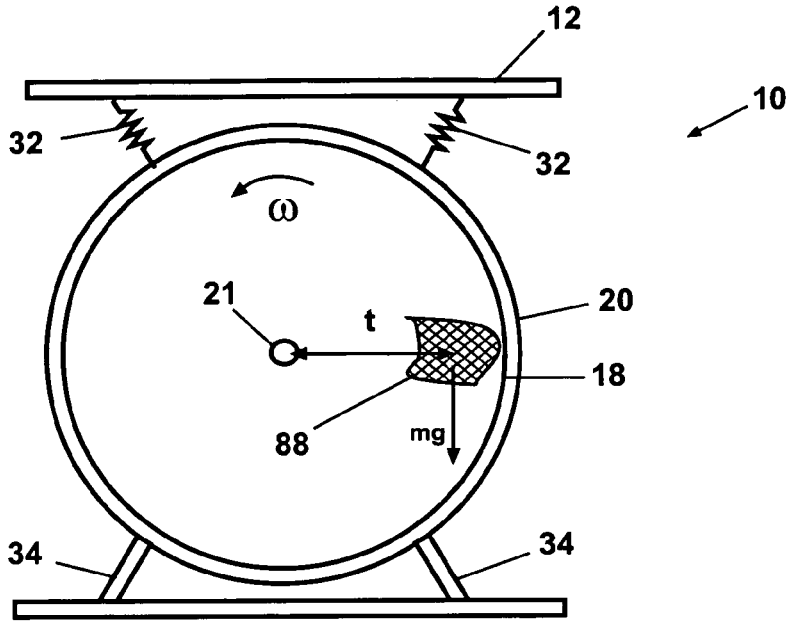
Fig. 4A (PRIOR ART)
FIGS. 4A and B are front and side elevational schematic representations of a horizontal axis washing machine subject to a rear single imbalance loading condition.
Figure 4B:
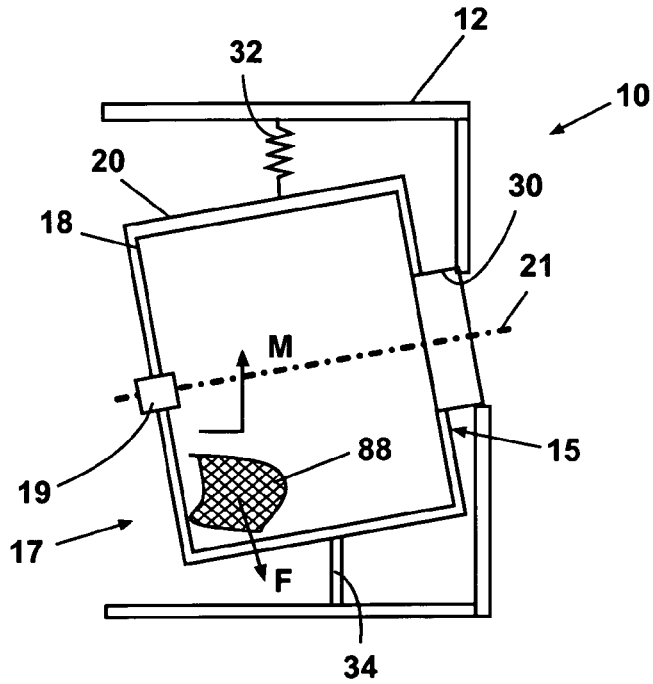
Fig. 4B (PRIOR ART)
Figure 5:
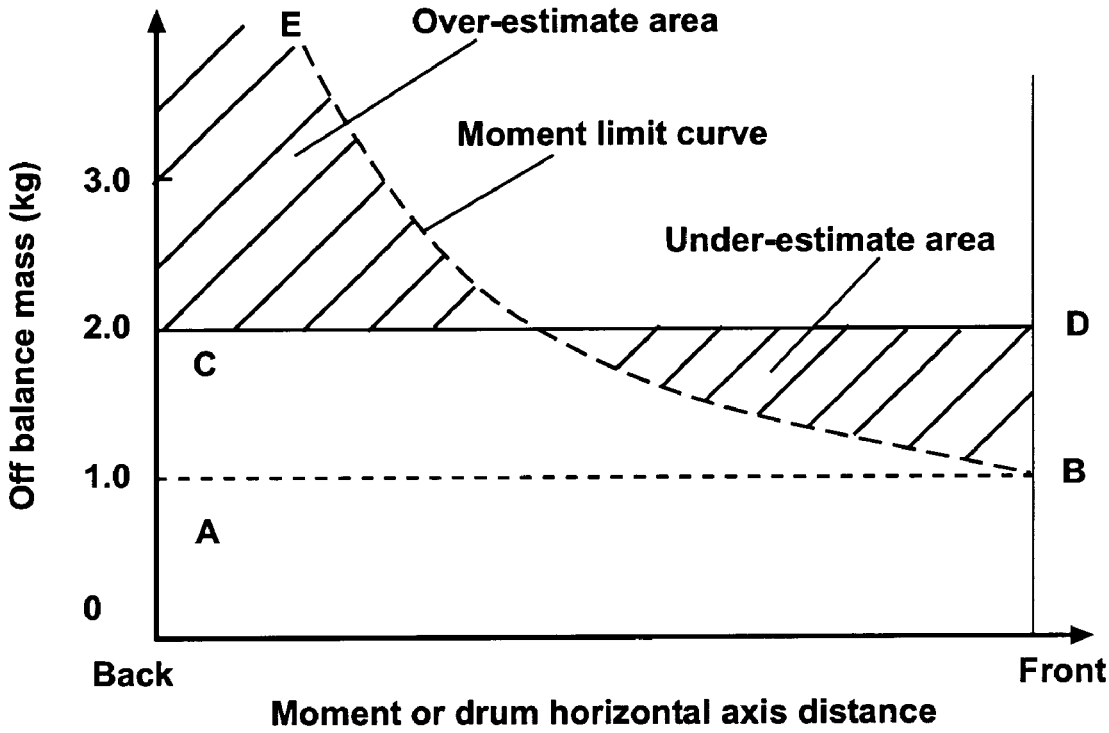
Fig. 5 (PRIOR ART)
FIG. 5 is a graphical representation of the relationship between the magnitude of the imbalance load and the dynamic moment for a horizontal axis washing machine.
Figure 6:
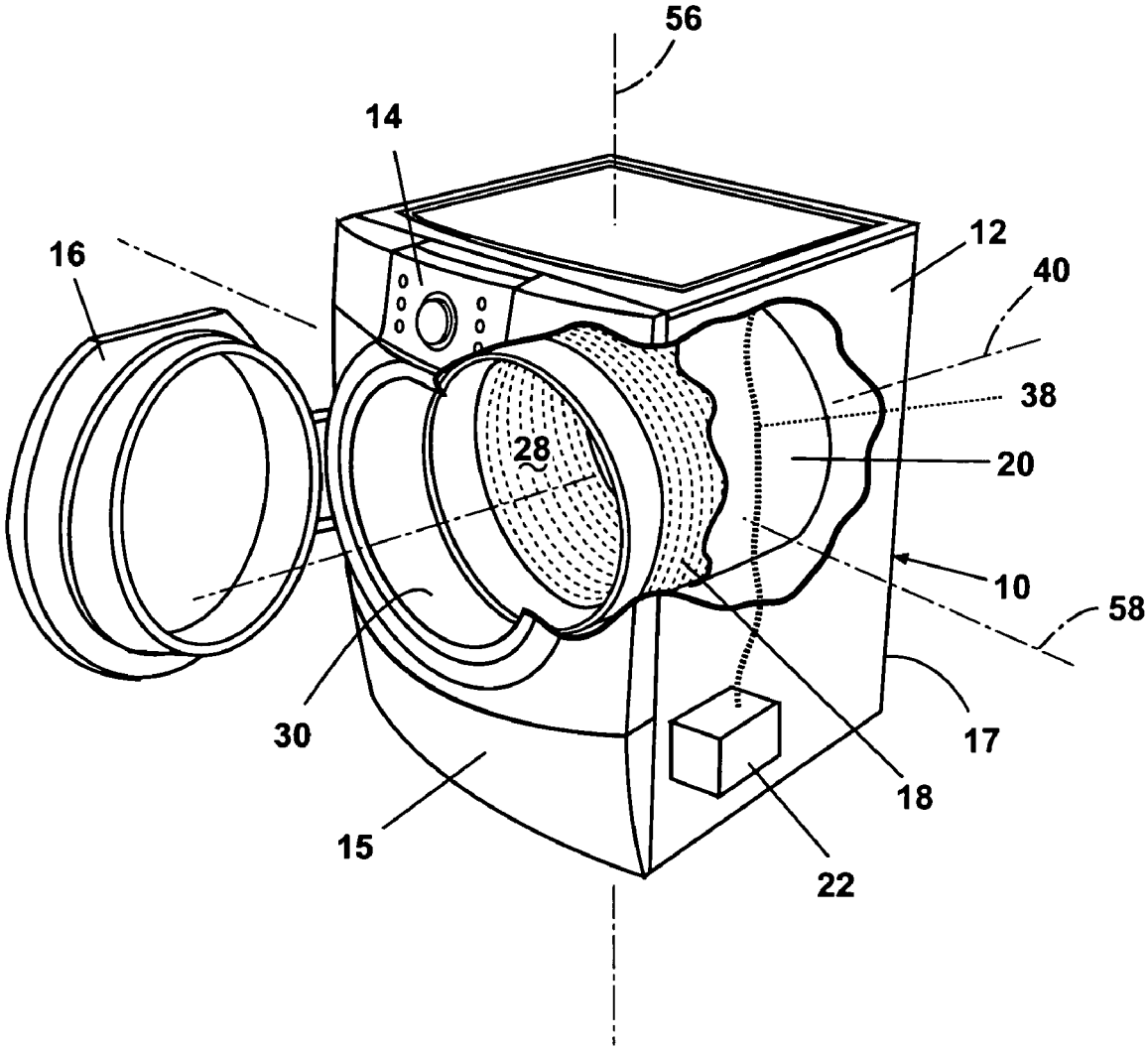
FIG. 6 is a partially cut away, perspective view of a horizontal axis clothes washer according to the invention.

Referring to the Figures, and in particular to FIG. 6, an embodiment of the invention illustrated as an automatic clothes washer 10 according to the invention is shown having a cabinet 12 with a front portion 15 and a rear portion 17. The front portion 15 has an opening 30 closeable by a door 16. The clothes washer 10 described herein shares many features of a well-known clothes washer, and will not be described in detail except as necessary for a complete understanding of the invention.

The cabinet 12 encloses a perforate rotatable basket 18 within a stationary imperforate tub 20. The cabinet 12 also mounts a control panel 14 having control elements, such as switches, dials, buttons, and the like, operably coupled with a solid-state microprocessor-based controller 22 for controlling the operation of the clothes washer 10. The basket 18 defines an axis of rotation 40, a generally vertical axis 56, and a generally horizontal axis 58. The vertical axis 56 and the horizontal axis 58 intersect at a longitudinal center point of the basket 18.

Figure 7:
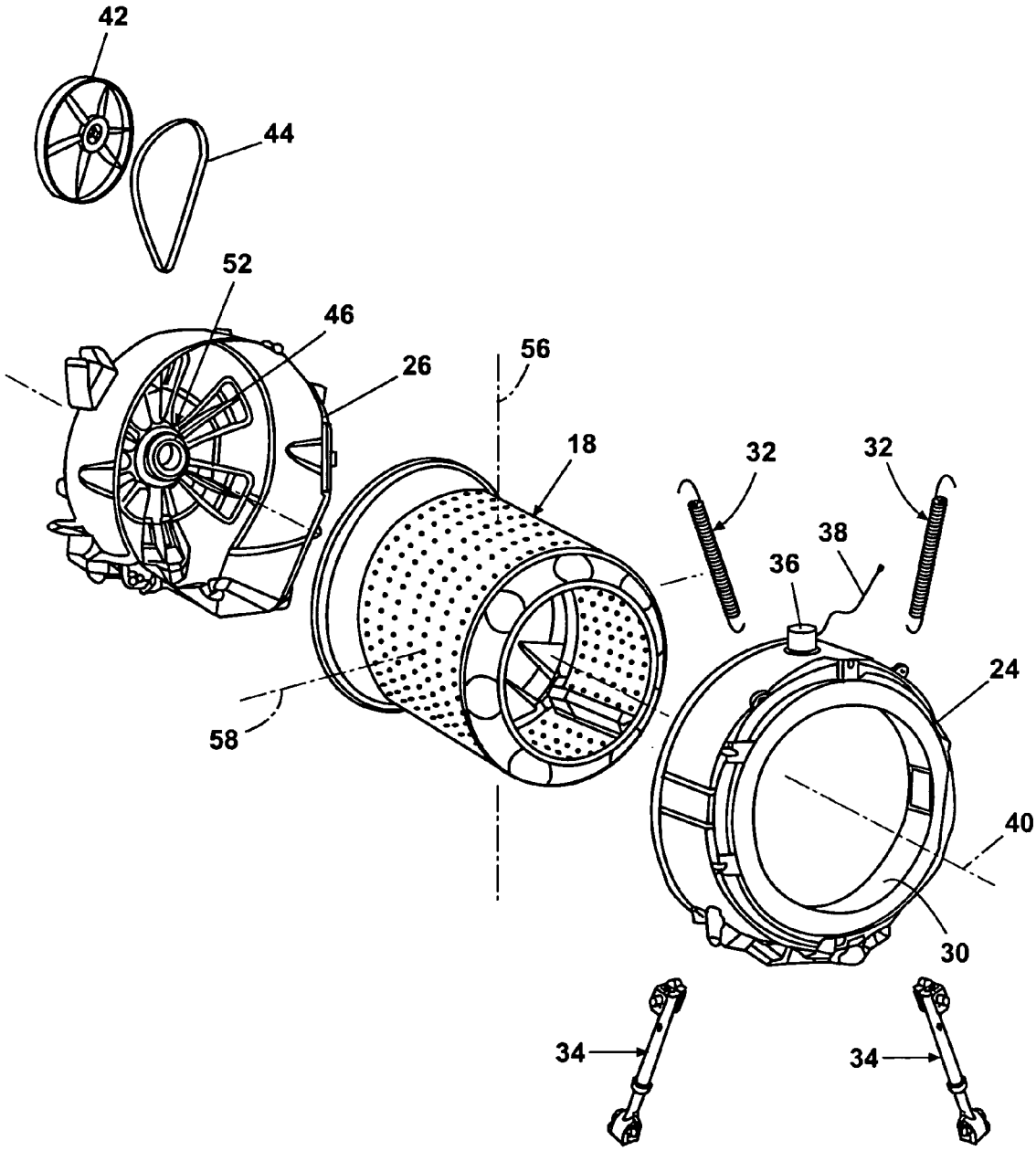
FIG. 7 is an exploded view of a rotating basket and tub assembly forming a portion of the horizontal axis clothes washer illustrated in FIG. 6.

Referring now to FIG. 7, the basket 18 is rotated by a motor (not shown) coupled to the basket 18 through a pulley 42 and a belt 44. The tub 20 is suspended from the cabinet 12 at its front portion by a pair of suspension springs 32. One or two pairs of dampers 34 are coupled to the cabinet 12 and the tub 20 at its front portion generally diametrically-opposed to the springs 32.

Figure 8A:
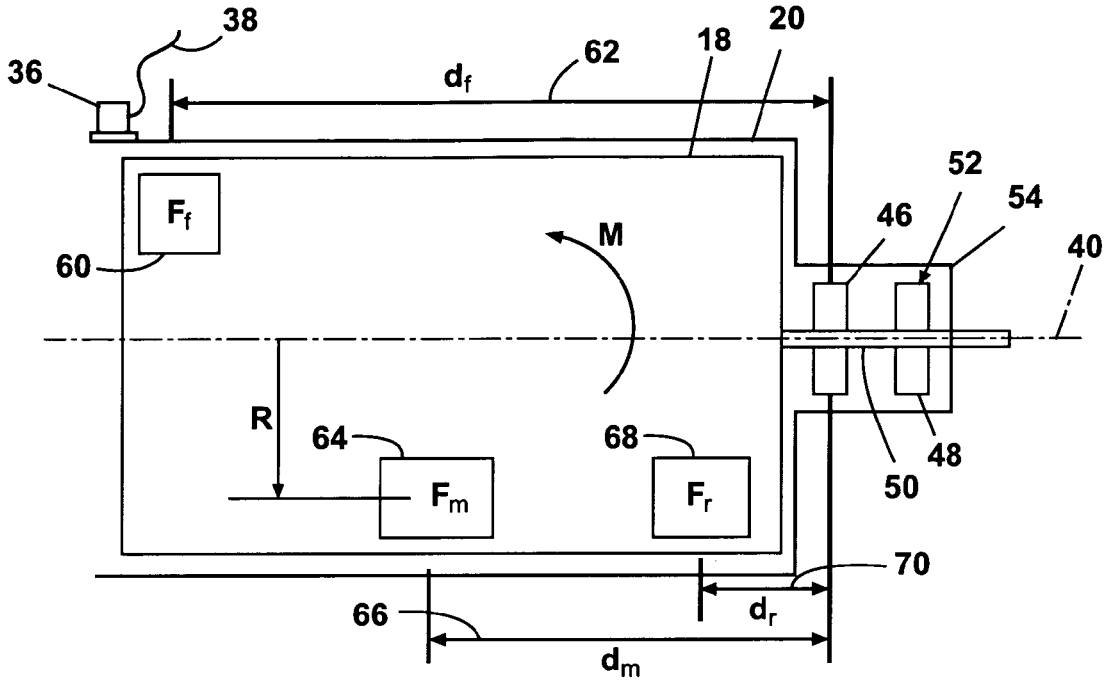
FIG. 8 is a schematic representation of the basket and tub assembly illustrated in FIG. 7 with loads and distances effecting different imbalance loading conditions.

Referring now to FIG. 8A, the basket 18 is supported on an axle 50 which is supported by and rotates within a bearing assembly 52 having a forward bearing 46 and a rear bearing 48 enclosed within a bearing housing 54. The bearing housing 54 can be integral with the tub 20. The axle 50 is horizontally, or nearly horizontally, disposed, and coaxial with the axis of rotation 40.

The basket 18, tub 20 and any other elements connected to them form a suspended mass for the washer that is suspended by the springs 32 and dampers 34. In most applications, the suspended mass will include the bearing assembly 52 and the axle 50. When a clothes load is placed into the basket, it also forms part of the suspended mass.

Figure 8B:
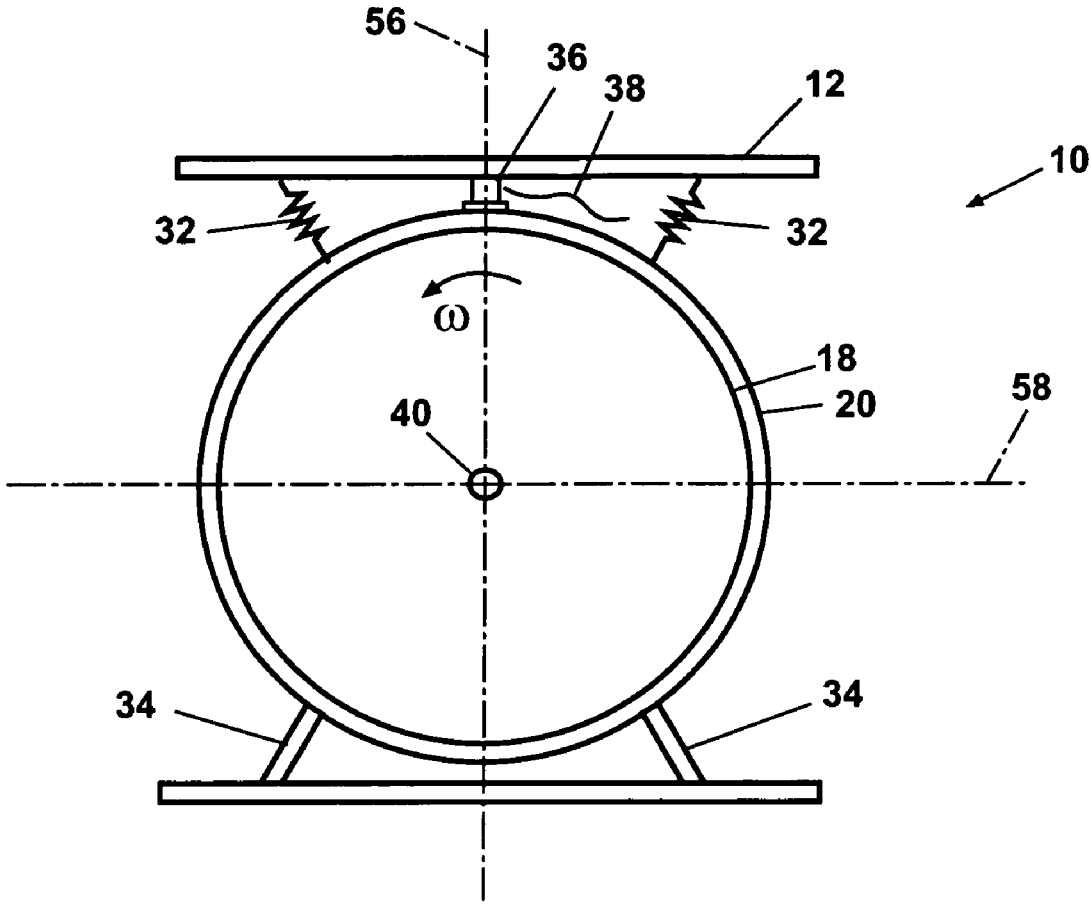

Referring also to FIG. 8B, a dual-axis acceleration transducer 36 is fixedly attached to the apex of the tub 20, preferred but not limit to, at its front portion, and is operably coupled through an electrical lead 38 to the controller 22. The transducer 36 can be any well-known acceleration transducer suitable for the purposes described herein, such as an analog or digital accelerometer, capable of responding to accelerations in at least one orthogonal direction. Although an accelerometer with another rating can be used, an accelerometer with a 2 g rating is preferred since it can not only measure a weak signal at low RPM with sufficient accuracy, but it can also measure a strong signal at high RPM with little or no saturation. Hereinafter, acceleration transducer and accelerometer will be used interchangeably to refer to a device capable of providing signal outputs corresponding to acceleration along at least one orthogonal axis to which the device is subjected.

The basket 18 rotates about the axis of rotation 40. Static and dynamic imbalance conditions can cause the basket 18 and the tub 20 to vibrate in a side-to-side movement, and in a front-to-back movement. The side-to-side movement will result in oscillation of the tub 20 about the vertical axis 56. The front-to-back movement will result in oscillation of the tub 20 about the horizontal axis 58. The vertical axis 56 is orthogonal to the horizontal axis 58, both of which are orthogonal to the axis of rotation 40. The acceleration transducer 36 is attached to the tub 20 so that the X-axis of the transducer 36 corresponds with the side-to-side oscillation about the vertical axis 56, and the Y-axis corresponds with the front-to-back oscillation about the horizontal; axis 58.

The acceleration transducer 36 generates voltage signals proportional to acceleration, which are transmitted through the lead 38 to the controller 22 for processing as hereinafter described. Preferably, the controller 22 is capable of receiving user-selected input signals and data from the acceleration transducer 36, performing mathematical and control algorithms utilizing the data, storing the data and results from the algorithms, sending control signals to displays and operational components such as motors and heating elements, and the like.

The acceleration transducer 36 is oriented relative to the longitudinal axis of the rotating basket so that a first output signal corresponds to a side-to-side acceleration, i.e. acceleration along the X-axis in an "X" direction, and a second output signal corresponds to a front-to-back acceleration, i.e. acceleration along the Y-axis in a "Y" direction. If the tub 20 is subjected concurrently to both side-to-side acceleration and front-to-back acceleration, the acceleration transducer 36 will generate separate output signals corresponding to the separate acceleration in both directions, which can be processed as hereinafter described.

In practice, the output of the accelerometer, i.e. voltage, is utilized in a hereinafter-discussed method of increasing the spin speed of the basket 18 through discrete steps, rather than actually calculating acceleration from the accelerometer output.

Referring to FIG. 8A, the mass of the vibrating system, including the basket 18, the tub 20, the axle 50, and the like, are readily determined. The mass of the total clothes load can be determined in a well-known manner, such as by evaluating the motor speed, current, or watts draw during motor start up at a preselected time during the operation of the clothes washer, as referenced in European Patent No. EP1167609, which is incorporated herein by reference. Some methods require that the basket angular velocity pass through the critical speed. Using the well-known relationship between centrifugal force caused by imbalance $$F=m R\omega^2$$

where

F=centrifugal force caused by imbalance;

m=mass of imbalance;

R=radial location of the imbalance to rotating axis; and

ω=angular velocity.

The moment M acting on the forward bearing 46 as illustrated in FIG. 8A can be calculated as $$M=Fd,$$

where d=longitudinal distance between imbalance load and forward bearing 46, and M=moment acting on forward bearing 46.

It should be briefly noted that for purposes of this discussion load (or weight) and mass are interchangeable. The mass of an object as used in this description varies from its weight by the gravitational constant.

The X-directional acceleration is directly proportional to the moment, M. When using an accelerometer according to the disclosed embodiment, the magnitude of the voltage signal from the accelerometer is proportional to the moment. Under such circumstances, it would not be necessary to actually calculate the moment. Instead, the voltage signal could be compared to representative voltage values that are indicative of values for the moment value of interest. The representative voltage values are usually empirically determined for the system.

One advantage of knowing the moment M at the bearing is that the location of the portion of the clothes load causing the imbalance can be determined once the imbalance mass or weight of clothing is determined. Many prior art horizontal axis washing machines enable the detection of the mass to differing degrees of accuracy. Once the moment M and the mass of the clothes load causing the imbalance are known, the distance d from the forward bearing 46 to the center of the portion of the clothes load can be calculated as:

$$d=M/F=M/mR\omega^2,$$

where

M=imbalance moment acting on forward bearing 46, calculated as above;

m=mass of imbalance clothes load, and d=longitudinal distance parallel to axis of rotation 40 from forward bearing 46 to center of mass of clothes load.

Referring again to FIG. 8A, a family of moments based upon different off-balance loads can be identified, as follows:

$$M_f=F_f d_f;$$

$$M_m=F_m d_m; \text{ and}$$

$$M_r=F_r d_r;$$

where $M_f$=moment relative to the forward bearing 46 due to a front imbalance load $F_f$ 60 located a distance $d_f$ 62 from the forward bearing 46;

$M_m$=moment relative to the forward bearing 46 due to a middle imbalance load $F_m$ 64 located a distance $d_m$ 66 from the forward bearing 46;

$M_r$=moment relative to the forward bearing 46 due to a rear imbalance load $F_r$ 168 located a distance $d_r$ 70 from the forward bearing 46.

The moments $M_f$, $M_m$, and $M_r$ are orthogonal to the axis of rotation.

For a coupled load due to a first load $F_f$ 60 located a distance $d_f$ 62 from the forward bearing and a second load $F_r$ 68 located a distance $d_r$ 70 from the forward bearing:

$$M_c=F_f d_f-F_r d_r.$$

If $F_f=F_r$, then $M_c=F_f(d_f-d_r)$. $M_c$, $M_f$, $M_m$, and $M_r$ cannot be determined with current technologies.

While the acceleration of the imbalance mass can easily be directly determined from the voltage output, a brief explanation of how the acceleration can be utilized should be useful. Under steady-state conditions, i.e. constant basket rotation, acceleration and displacement have the following relationship:

$$X_a=-\omega^2 X_d$$

where $X_a$=acceleration in X-direction, $X_d$=displacement in X-direction, and

ω=angular velocity.

From the above equation we can see how an accelerometer can predict cabinet hits, which is displacement, using acceleration information. On the other hand, we can recognize that the accelerometer is only one of several possible sensors that can be used in this invention. Other devices can include proximity sensors, laser or optical displacement sensors, and the like. In accordance with the invention, acceleration is evaluated in at least one direction, but preferably in two orthogonal directions relative to the longitudinal axis of the basket, since the second direction capability is readily available at nominal cost. Thus:

$X_a$=side-to-side acceleration; and $Y_a$=front-to-back acceleration.

The accelerometer determines a resulting RMS acceleration from the individual accelerations in both directions, calculated as:

$$XY_a=\sqrt{X_a^2+Y_a^2}$$

The RMS acceleration is determined continuously to enable the avoidance of severe vibration before it occurs. The acceleration (in voltage before calibration) at each speed is compared to a limit setting established for each speed, and is calculated according to the following relationship:

$$XY = \sqrt{\sum (X_j - X_{av})^2 + (Y_j - Y_{av})^2 / n}$$

and $$XY < L_{RPM}$$

where

XY=RMS acceleration at a selected speed;

$X_j$=side-to-side acceleration for sample number j;

$Y_j$=front-to-back acceleration for sample number j;

$$X_{av} = \sum_{j=1}^{n} X_j / n,$$

side-to-side average acceleration at the selected speed;

$$Y_{av} = \sum_{j=1}^{n} Y_j / n,$$

front-to-back average acceleration at the selected speed;

j=1, 2, . . . n; n=preselected number of samples, preferably 100 to 400;

$L_{RPM}$=$L_{70}$, $L_{140}$, . . . , $L_{1200}$; limit setting for indicated speed.

Alternatively, weighted settings can be used for cases with special side-to-side or front-to-back clearance requirements:

$$XY=\sqrt{X^2+kY^2};$$

where $$k=0\sim2.$$

In yet another alternative, separate limit settings can be used for the side-to-side and front-to-back directions.

The determination of Y-direction acceleration, which can predict front-to-back vibration and prevent glass/door hits, is preferred, but not as important as the determination of side-to-side acceleration. Consequently a single-axis accelerometer can be used for this invention if there is a cost saving advantage. However, two-axis accelerometers are readily available, and three-axis accelerometers are available at additional cost.

For the illustrative washing machine as described, the resonance for the suspended mass has been empirically determined to occur around 160 to 200 PRM, which is referred to as the critical speed zone. The critical speed corresponds with the resonance frequency of the suspended mass, i.e. the basket, tub, clothes load, and retained liquid. Empirical data indicates that the greater the acceleration measured at 140 RPM, the greater the displacement when the washer ramps through the critical speed zone. Consequently, acceleration measured at 140 RPM can predict the severity of cabinet hits during ramp through the critical speed, and enable preventative measures to reduce the severity of cabinet hits. The 140 RPM speed is selected to avoid spinning the basket and clothes load at the resonant frequency, yet generate sufficient speed and vibration to indicate whether an imbalance will cause excessive vibration at a higher speed. The resonance frequency, the critical speed, and the "test" speed (i.e. corresponding to the 140 RPM speed) are unique to a specific washer and load configuration, and may vary from the above values.

The limit settings are empirically determined values unique to a specific clothes washer based upon such factors as clothes washer type, load size and type, spin speed, basket size, kind of accelerometers selected and the like. Preferably, the limit settings are expressed in terms of voltage values for direct comparison with the voltage output from the acceleration transducer 36. An example of such limit settings is illustrated in tabular form in FIG. 9A. FIG. 9B is a tabulation of pertinent specifications for an accelerometer corresponding to the limit settings illustrated in FIG. 9A. An accelerometer having different specifications will have different limit settings. The limit settings can be established for a range of loads at each speed. Preferably, the limit settings will be stored as an array or matrix of values in the controller 22.

As the basket is rotated, continuous outputs are generated from the acceleration transducer 36 corresponding to the X-direction acceleration and the Y-direction acceleration, and sent to the controller. A selected number n of regularly-determined X-direction and Y-direction accelerations are averaged, and the RMS acceleration XY is calculated according to the above equation. This RMS acceleration is then compared to the appropriate limit setting stored in the controller.

Figure 10:
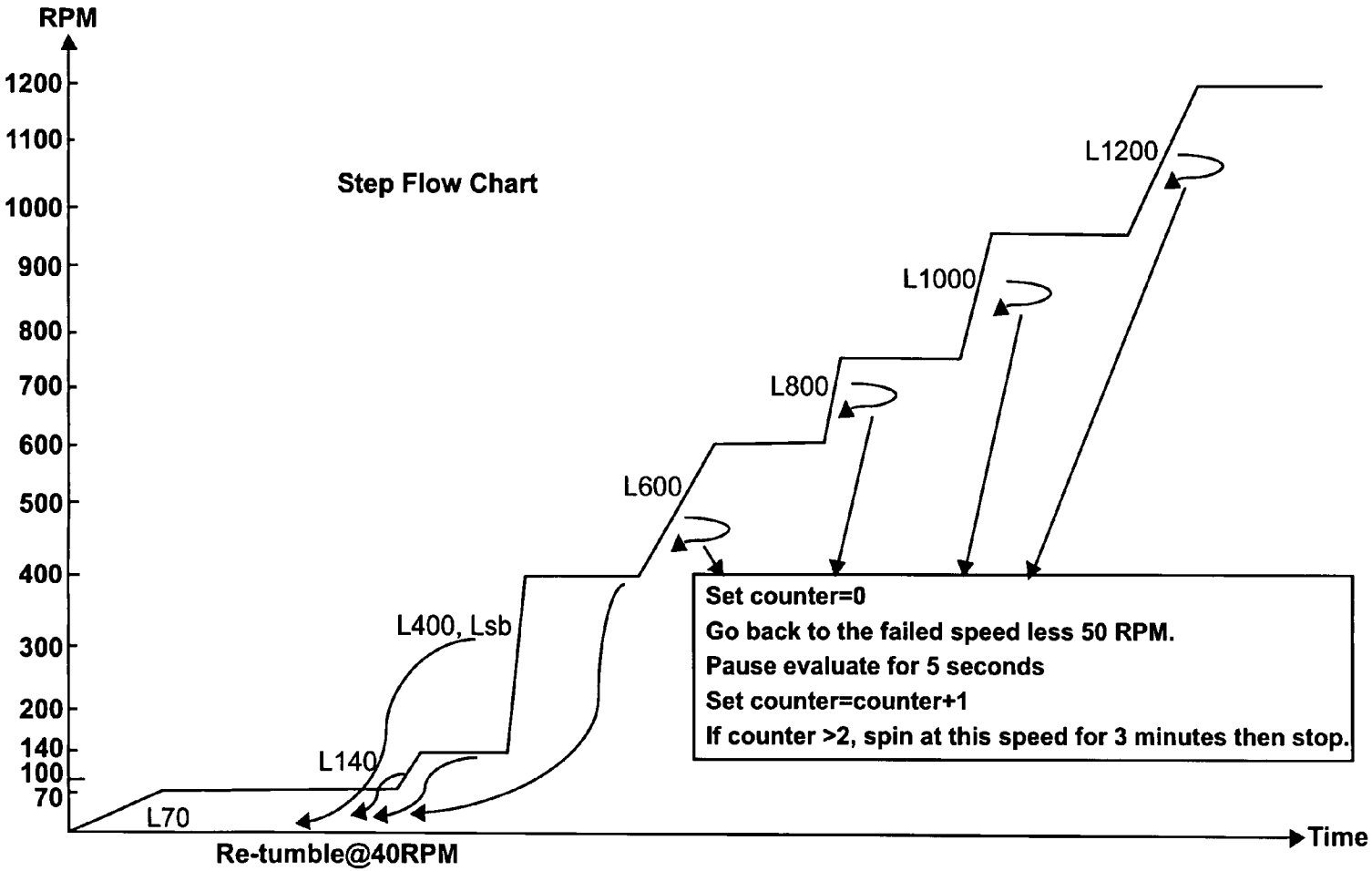
FIG. 10 is a graphical representation of a step flow chart for operating a spin cycle for the clothes washer illustrated in FIG. 7.
Figure 11A:
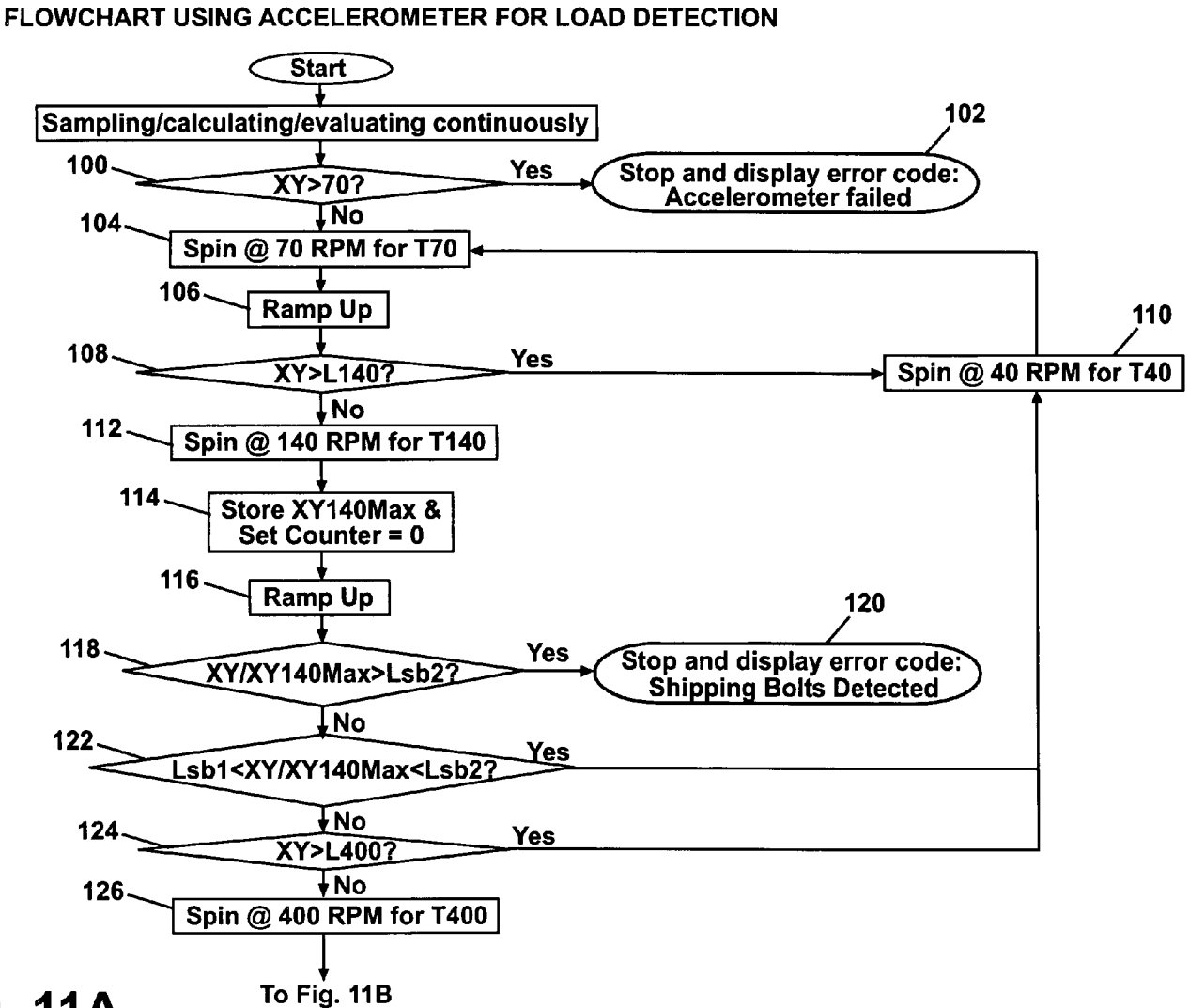
FIGS. 11A-D illustrate a flow chart for operating the spin cycle for the clothes washer illustrated in FIG. 7.
Figure 11B:
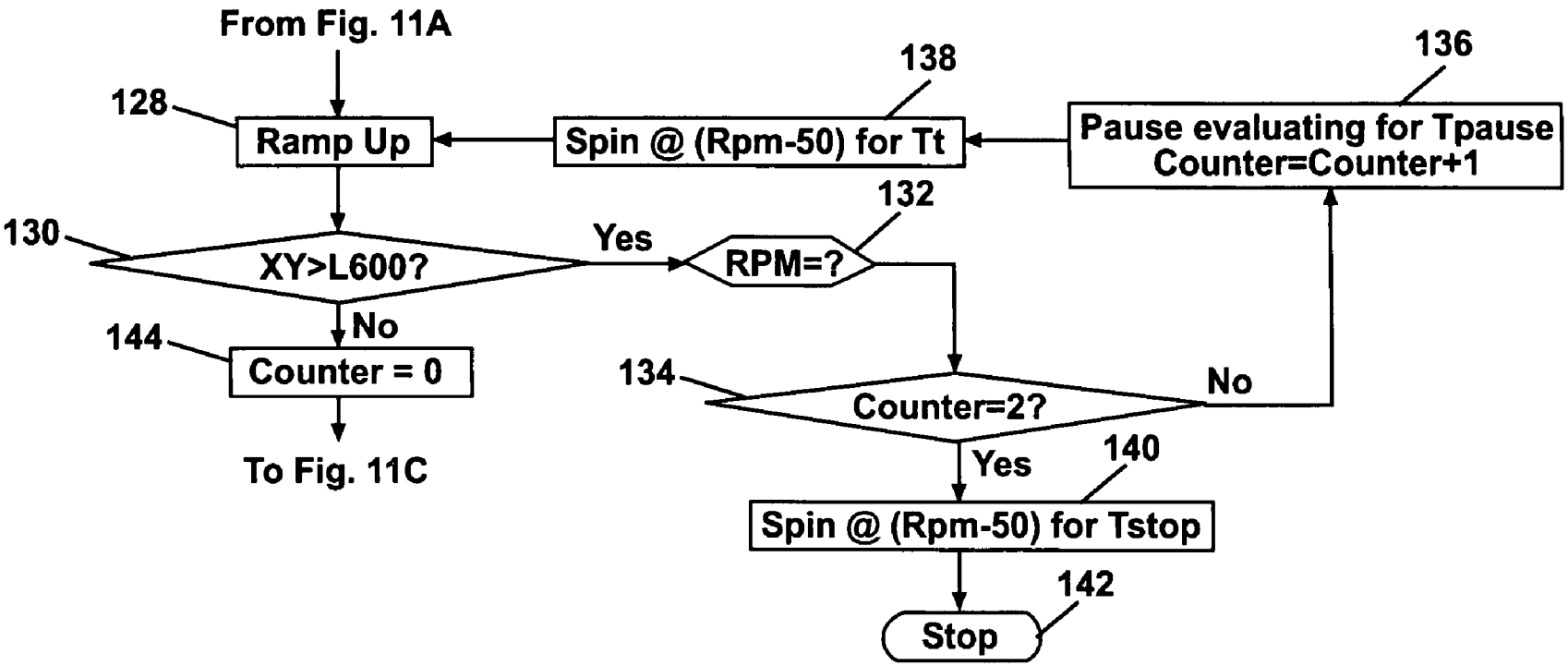
Figure 11C:
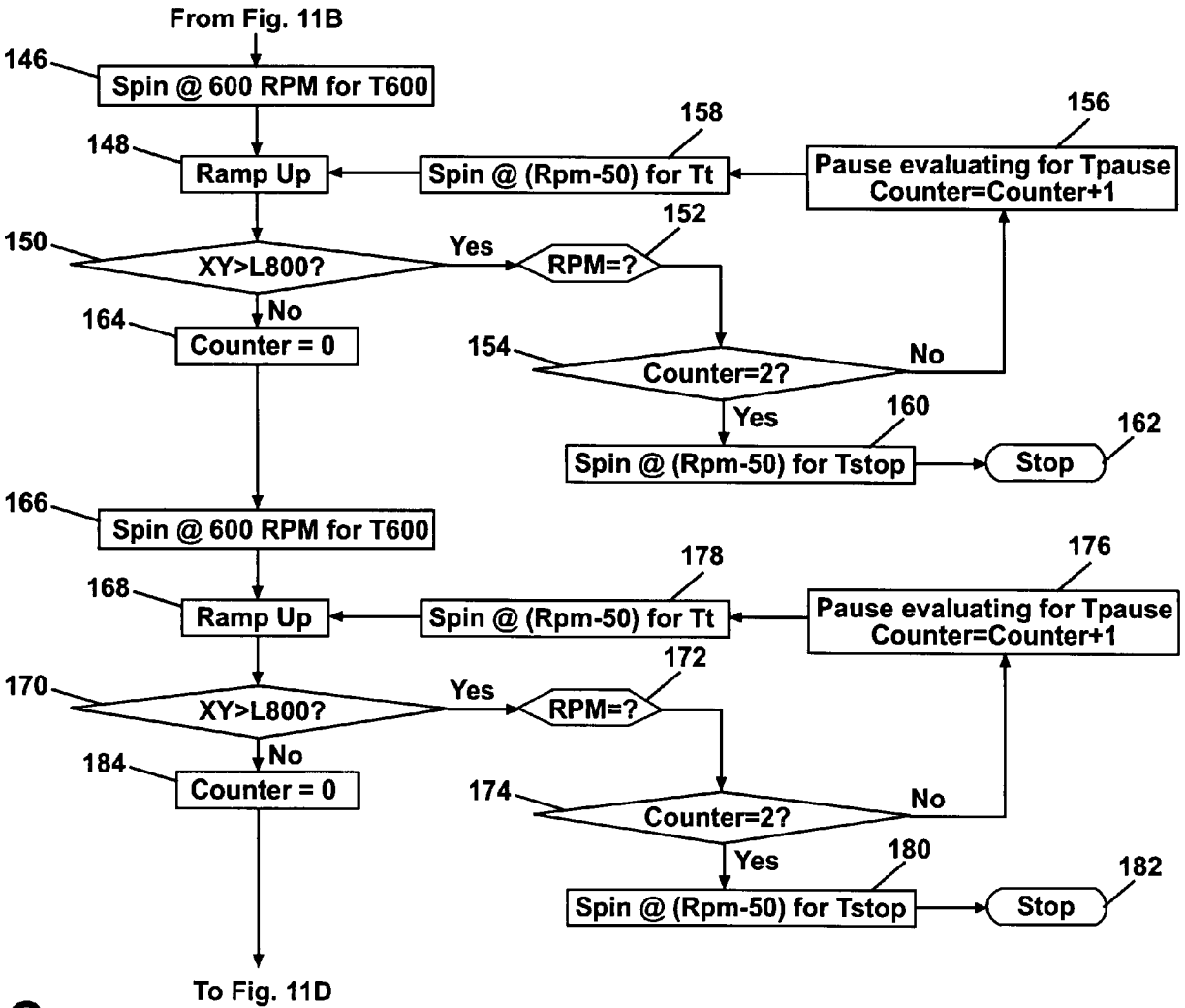
Figure 11D:
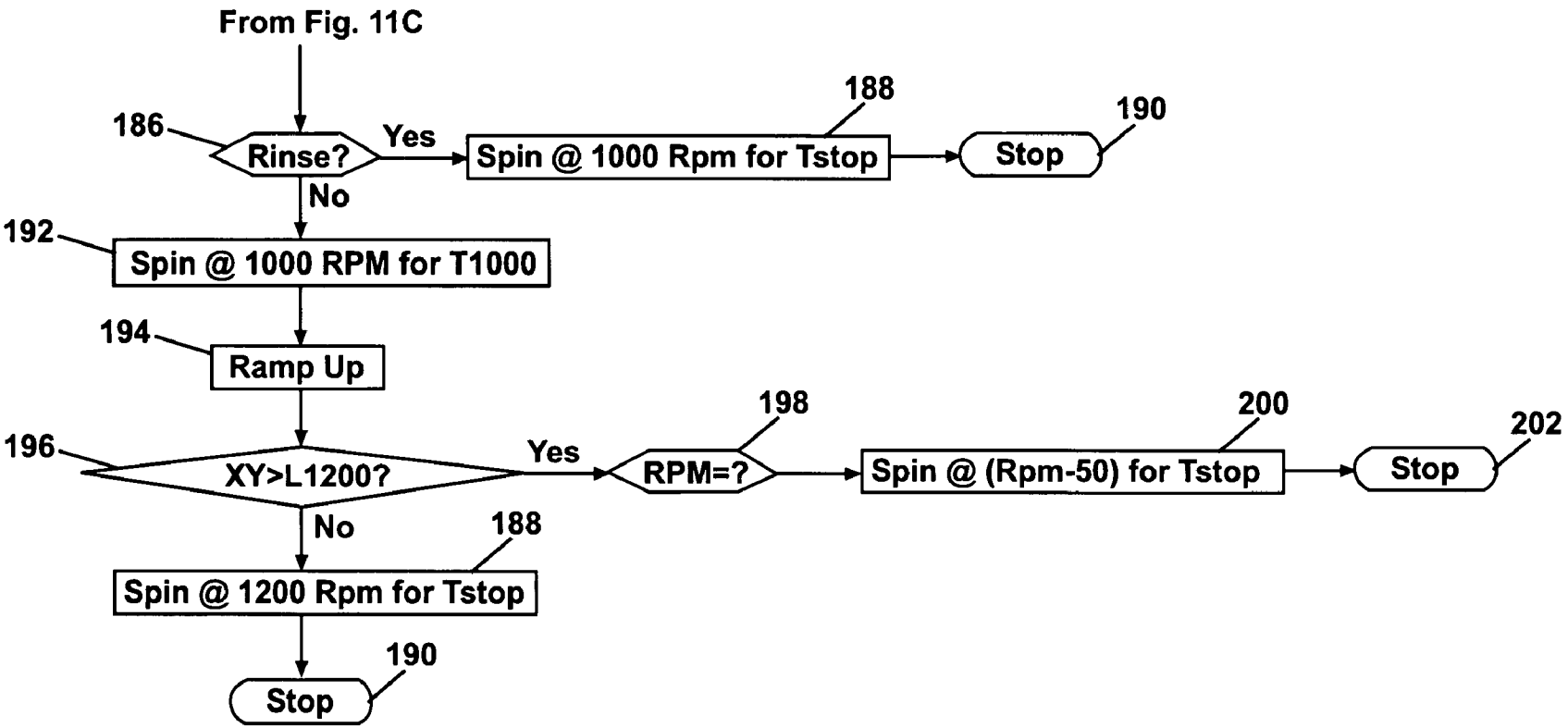

Referring to FIG. 10, the $L_{70}$ setting, which is the preselected acceleration limit at a basket speed of 70 RPM, is mainly used for purposes of detecting accelerometer failure prior to increasing the rotational speed of the basket. Thus, when the spin cycle is initiated, the basket speed is increased up to 70 RPM while the output from the acceleration transducer 36 is evaluated. If the $L_{70}$ limit is not exceeded, the basket speed is increased to 140 RPM.

The $L_{140}$ setting is used to prevent cabinet hits during ramp up of the basket speed to a high speed up to 1200 RPM, and to evaluate whether there is a likelihood of severe vibration at high speeds. As discussed above, the 140 RPM speed is established based upon the resonance frequency of the suspended mass. It has been determined that if the conditions in the basket do not result in the output from the accelerometer at 140 RPM exceeding the $L_{140}$ setting, the basket can typically be safely increased to the next high RPM.

The higher limit settings, i.e. $L_{140}$, $L_{600}$ . . . $L_{1200}$ are set based upon an average liquid extraction rate and RPM selected, and to prevent catastrophic vibration due to unexpected conditions. For example, some clothes loads have a relatively low liquid extraction rate and can cause severe vibration at high speeds. If the clothes washer 10 is operated in a very cold environment and then the dampers have big damping forces, a large off-balance load could be ramped up to a high speed without cabinet hits. However, it would be detected at 400 RPM by limit setting $L_{400}$. When the machine is warmed up, the load will not progress past 140 RPM due to the $L_{140}$ limit.

FIGS. 11A-D illustrate a flow chart for the invention. Referring also to FIG. 10, at the point in a wash cycle when the clothes washer 10 enters a spin cycle, the output from the accelerometer 36 is continuously sampled and evaluated against the limit settings. The speed of the basket is ramped up to 70 RPM, and the output of the accelerometer during the ramp up to 70 RPM is compared to the $L_{70}$ limit setting in step 100. If the output from the accelerometer during ramp up or at 70 RPM is greater than the $L_{70}$ limit setting, the basket spin is terminated and an error code is displayed indicating accelerometer failure, as shown in step 102. If the output from the accelerometer is less than or equal to the $L_{70}$ limit setting, the basket is rotated, as shown in step 104, at 70 RPM for a preselected time $T_{70}$ After time $T_{70}$, the speed of the basket is ramped up, as shown in step 106, to 140 RPM. The output from the accelerometer during the ramp up to 140 RPM is compared to the $L_{140}$ limit setting, as shown in step 108. If the output from the accelerometer during ramp up or at 140 RPM is greater than the limit setting $L_{140}$, the basket is rotated, as shown in step 110, at 40 RPM for a preselected time $T_{40}$. This is followed by a repeat of step 104, i.e. rotation of the basket at 70 RPM for preselected time $T_{70}$, followed by a second ramping up of the basket speed to 140 RPM. This process is continued until the output from the accelerometer 36 is less than or equal to the $L_{140}$ limit setting.

The basket is then rotated, as shown in step 112, at 140 RPM for a preselected time $T_{140}$. The maximum value of the output from the accelerometer at 140 RPM is stored as shown in step 114, and a counter is set to a value of zero. The speed of the basket is then ramped up toward a speed of 400 RPM, is shown in step 116, while a quotient, which is equal to the value of the output from the accelerometer divided by the previously stored maximum value of the output from the accelerometer at 140 RPM, is compared to a limit setting $L_{sb2}$ reflecting the presence of unremoved shipping bolts, as shown in step 118. If the quotient is greater than the limit setting $L_{sb2}$, the basket spin is terminated and an error code is displayed indicating that shipping bolts are detected, as shown in step 120.

If the quotient is less than the limit setting $L_{sb2}$ but greater than a limit setting $L_{sb1}$, the basket is rotated at 40 RPM for preselected time $T_{40}$ followed by spinning at 70 RPM for $T_{70}$, ramping up to 140 RPM, and repeating of the process. Examples of the limit settings $L_{sb1}$, $L_{sb2}$, are illustrated in the Table of FIG. 9.

If the quotient is less than the limit setting $L_{sb1}$, the output from the accelerometer is then compared to the $L_{400}$ limit setting, as shown in 124. If the output from the accelerometer is greater than the $L_{400}$ limit setting, the basket is rotated at 40 RPM for preselected time $T_{40}$ followed by spinning at 70 RPM for $T_{70}$, ramping up to 140 RPM, ramping up to 400 RPM, and repeating of the process until the output from the accelerometer is less than or equal to the limit setting $L_{400}$. The basket is then rotated, as shown in step 126, at 400 RPM for a time $T_{400}$.

When time $T_{400}$ has expired, the rotation of the basket is ramped up, as shown in step 128, toward 600 RPM. The output from the accelerometer during the ramp up to 600 RPM is compared as shown in step 130, to the limit setting $L_{600}$. If the output from the accelerometer during ramp up or at 600 RPM is greater than the limit setting $L_{600}$, the speed of the basket corresponding to an accelerometer output greater than the limit setting $L_{600}$ is determined, as shown in step 132. The routine then queries as shown in step 134 whether the counter value is 2. If the counter value is 2, the basket is rotated at a speed equal to the RPM determined in step 132 minus 50 RPM for a time $T_{stop}$, as shown in step 140, followed by termination of the spin cycle, as shown in step 142.

If the counter value is not equal to 2, the evaluation process is paused for a time $T_{pause}$, as shown in step 136, and the counter value is incremented by 1. The basket is then rotated at a speed equal to the RPM determined in step 132 minus 50 RPM for a time $T_t$ (say, one minute), followed by a second attempt to increase the speed of the basket to 600 RPM. The process is continued either until the counter value equals 2, leading to a final spin and termination of the spin cycle, or until the output from the accelerometer is less than or equal to the limit setting $L_{600}$.

Referring also to FIG. 10, if the output from the accelerometer is less than or equal to the limit setting $L_{600}$, the counter is reset, as shown in step 144, to 0, and the basket is rotated, as shown in step 146, at 600 RPM for a time $T_{600}$. The speed of the basket is then ramped up toward 800 RPM, as shown in step 148, during which a process similar to that described for the ramping up to 600 RPM is employed. During the ramping up of the basket, the output from the accelerometer 36 is compared, as shown in step 150, to a limit setting $L_{800}$. If the output from the accelerometer is greater than the limit setting $L_{800}$, the speed of the basket is determined at that output, as shown in step 152, and the routine then queries, as shown in step 154, whether the counter value is 2.

If the counter value is 2, the basket is rotated at a speed equal to the RPM determined in step 152 minus 50 RPM for a time $T_{stop}$, as shown in step 160, followed by termination of the spin cycle, as shown in step 162. If the counter value is not equal to 2, the evaluation process is paused for a time $T_{pause}$, as shown in step 156, and the counter value is incremented by 1. The basket is then rotated at a speed equal to the RPM determined in step 152 minus 50 RPM for a time $T_t$, followed by a second attempt to increase the speed of the basket to 800 RPM. The process is continued either until the counter value equals 2, leading to a final spin and termination of the spin cycle, or until the output from the accelerometer is less than or equal to the limit setting $L_{800}$.

If the output from the accelerometer is less than or equal to the limit setting $L_{800}$, the counter is reset, as shown in step 164, to 0, and the basket is rotated, as shown in step 166, at 800 RPM for a time $T_{800}$. The speed of the basket is then ramped up toward 1000 RPM, as shown in step 168, during which the process for the ramping up to 600 RPM and 800 RPM is employed. The output from the accelerometer is compared, as shown in step 170, to a limit setting $L_{1000}$, and, if greater than the limit setting $L_{1000}$, the RPM at that output is determined, as shown in step 172, followed by a determination, as shown in step 174, of whether the counter value is 2. Depending upon the counter value, the basket is rotated at a speed 50 RPM less than the speed determined in step 172 for a time $T_{stop}$, followed by termination of the spin cycle, as shown in step 182, or the counter value is incremented, the basket is rotated, as shown in step 178, for a time $T_t$, and the ramp up process is repeated. The process is continued until the counter value equals 2, leading to a final spin and termination of the spin cycle, or until the output from the accelerometer is less than or equal to the limit setting $L_{1000}$.

If the output from the accelerometer is less than or equal to the limit setting $L_{1000}$, the counter is set to 0 in step 184, and a determination is made whether the spin cycle is part of a rinse cycle, as shown in step 186. If it is, the basket is rotated at 1000 RPM for a time $T_{stop}$, as shown in step 188, and the spin cycle is terminated, as shown in step 190. If it is not, the basket is rotated at 1000 RPM for a time $T_{1000}$, as shown in step 192, followed by ramping up, as shown in step 194, of the basket speed toward 1200 RPM. The output from the accelerometer during the ramp up to 1200 RPM is compared to a limit setting $L_{1200}$, as shown in step 196. If the output is greater than the limit setting $L_{1200}$, the speed of the basket is determined in step 198 followed by rotation of the basket at a speed 50 RPM less than the speed determined in step 198 for a time $T_{stop}$, as shown in step 200, followed by termination of the spin cycle, as shown in step 202. If the output from the accelerometer is less than or equal to the limit setting $L_{1200}$, the basket is rotated at 1200 RPM for a time $T_{stop}$, as shown in step 204, followed by termination of the spin cycle, as shown in step 206.

Preferably, $T_{pause}$ is set as five seconds, and $T_{stop}$ is set as two to three minutes. FIG. 10 illustrates in graphical form the ramping up of the speed of the basket to a maximum of 1200 RPM. It can be seen from FIG. 10 that for speeds between 140 and 400 RPM, failure to satisfy the limit settings $L_{140}$ and $L_{400}$ leads to a spinning of the clothes at 40 RPM. For speeds greater than 400 RPM, failure to satisfy the limit settings $L_{600}$, $L_{800}$, $L_{1000}$, and $L_{1200}$, results in spinning of the clothes at the speed at which the condition was not met minus 50 RPM, rather than by simply reverting to the previous preprogrammed speed. Thus, for example, if during a ramp up from 800 to 1000 RPM, the limit setting $L_{1000}$ is exceeded at a basket speed of 925 RPM, the basket is rotated at a speed of 875 RPM rather than the preprogrammed speed of 800 RPM.

The speeds, e.g. 400, 600, . . . , 1200 RPM, associated with the limit settings e.g. $L_{400}$, $L_{600}$, . . . , $L_{1200}$, are somewhat arbitrarily selected, and can be set at speeds other than the values described herein depending upon washer parameters such as the size of the basket and tub, the design clothes load, the design maximum speed, the washer suspension system configuration, resonance frequencies, and the like.

As a practical matter, while the moment acting on the bearing, and the distance from the forward bearing to the center of mass of the clothes load can be determined, such determinations will not typically be made since, if a load imbalance occurs, the spin cycle is adjusted by reducing the spin speed and/or redistributing the clothes load in the basket 18, as previously described.

The use of an accelerometer has other advantages. For example, an off-balance load in the front of the basket 18 will impose a higher moment on the forward bearing 46 than the same size load at the rear of the basket 18. However, prior art technologies that use motor torque, speed, or current to detect an off-balance load treat all off-balance loads the same regardless of their location within the basket 18. The accelerometer-based system described herein can account for the location of the off-balance load and, in the case of an off-balance load at the rear of the basket 18, ramp up to a higher spin speed.

The use of dampers is critical in controlling resonant vibration. However, temperature affects damping performance. For example, the temperature of a damper can arise from 70° F. (typical room temperature) to 120° F. during the first rinsing and spinning, which may involve a spin speed of 800 RPM. The temperature may fall to 90° F. before the second rinsing and spinning. Due to the temperature change, the dampers may perform differently, and consequently, vibration and displacement may increase at and through the 140 RPM spin speed. Prior art technologies cannot detect these changes and the spin cycle may continue with unacceptable vibrations and cabinet hits. However, the accelerometer-based system described herein can detect the differences in vibration due to these effects and adjust the spin cycle accordingly.

At times, the clothes washer may be supported upon a soft floor. At 140 RPM a soft floor will cause increased vibration and potentially unacceptable vibration and cabinet hits at higher speeds. The accelerometer-based system can detect these increased vibrations and adjust the spin cycle accordingly. Similarly, improper installation of the clothes washer may result in the clothes washer being supported on only three legs. This can also lead to increased vibration and cabinet hits, which the accelerometer can detect at the 140 RPM speed, and the spin cycle can be adjusted accordingly.

The accelerometer-based system can also accommodate a load consisting of a single bath towel or similar small, but readily imbalanced, load. Furthermore, in response to a load imbalance detected at a particular speed, prior art technologies reduce the spin speed to the prior stage spin speed, which may be a 200 RPM decrease. With the accelerometer-based system described herein, the spin speed is reduced 50 RPM, thereby providing more effective extraction of liquid notwithstanding the imbalance of the load.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for controlling a spin cycle in an automatic clothes washer comprising an imperforate tub, a perforate basket located within the tub, a bearing assembly carried by the tub, a drive shaft rotationally supported in the bearing assembly and coupled to the basket to define a rotational axis of the basket, a drive assembly rotating the drive shaft, and a controller operably coupled to a drive assembly, with the controller controlling the drive mechanism to control a spin rate of the basket according to a spin cycle, the method comprising:

rotating the basket from a rotational rate less than a resonance rate, which corresponds to a resonance frequency of the clothes washer, to a spin rate, which is greater than the resonance rate;

determining a moment of force acting on the bearing assembly while the basket is rotating at a rate less than the resonance rate;

comparing the determined moment of force to a threshold moment; and controlling the spin rate of the basket in response to the determined moment of force by accelerating the rotation rate of the basket to the spin rate when the determined moment is less than the threshold moment.

2. The method according to claim 1, wherein the determining of the moment comprises sensing the acceleration or displacement of one of the tub and basket about at least one axis different than the rotational axis of the basket.

3. The method according to claim 2, wherein the sensing of the acceleration or displacement of one of the tub and the basket comprises sensing the acceleration or displacement of the tub.

4. The method according to claim 2, wherein the at least one axis is orthogonal to the rotational axis.

5. The method according to claim 2, wherein the determining of the moment comprises determining the displacement of the tub.

6. The method according to claim 2, wherein the at least one axis comprises two axes.

7. The method according to claim 6, wherein the two axes are orthogonal to each other.

8. The method according to claim 1, wherein a location of an imbalanced load is determined based on the determined moment.

9. The method according to claim 8, wherein the determining of the location of the imbalance comprises determining the effective mass of an imbalance in the basket.

10. The method according to claim 9, wherein the determining of the location of the imbalance comprises calculating the location relative to the bearing assembly based on the effective mass and the sensed moment.

11. The method according to claim 1, wherein the spin rate is increased toward a maximum spin rate.

12. The method according to claim 11, wherein the spin cycle is terminated when the determined moment is indicative of the tub being improperly suspended.

13. The method according to claim 1, wherein if the determined moment exceeds the moment threshold, the spin rate is decreased.

14. The method according to claim 13, wherein the decreasing of the spin rate comprises at least part of a redistribution step.

15. The method according to claim 14, wherein the redistribution step comprises repeated steps of increasing the spin rate toward the spin rate corresponding to the resonance frequency and decreasing the spin rate if the determined moment exceeds the moment threshold.

16. The method according to claim 1, wherein the presence of a dynamic imbalance associated with the basket is determined based on the determined moment.

* * * * *

UNITED STATES PATENT AND TRADEMARK OFFICE

CERTIFICATE OF CORRECTION

PATENT NO. : 7,581,272 B2
APPLICATION NO. : 11/438001
DATED : September 1, 2009
INVENTOR(S) : Xie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 635 days.

Signed and Sealed this

Fourteenth Day of September, 2010

David J. Kappos

David J. Kappos
*Director of the United States Patent and Trademark Office*